United States Patent [19]

Pritchard

[11] 4,204,600

[45] May 27, 1980

[54] DUAL POCKET ENVELOPE

[75] Inventor: Sheldon S. Pritchard, Houston, Tex.

[73] Assignee: Champion International Corporation, Stamford, Conn.

[21] Appl. No.: 971,411

[22] Filed: Dec. 20, 1978

Related U.S. Application Data

[63] Continuation of Ser. No. 885,603, Mar. 3, 1978, abandoned.

[51] Int. Cl.[2] ..... B65D 27/36

[52] U.S. Cl. ..... 206/610; 229/71; 229/72

[58] Field of Search ..... 229/71, 72; 206/610, 206/611

[56] References Cited

U.S. PATENT DOCUMENTS

| | | | |
|---|---|---|---|
| 2,055,716 | 9/1936 | Berkowitz | 229/71 X |
| 2,256,638 | 9/1941 | Blakeney | 206/610 |
| 2,828,065 | 3/1958 | Heywood | 206/610 |
| 3,420,432 | 1/1969 | Cooper | 229/72 |

*Primary Examiner*—Stephen P. Garbe

*Attorney, Agent, or Firm*—Evelyn M. Sommer

[57] ABSTRACT

A dual pocket, easy opening envelope has a first envelope pocket defined by a front panel and an overlying rear panel secured by inwardly folded side flaps at the edges of the front panel. A separate panel is secured to the inside surface of the front panel to form a second envelope pocket. The front panel includes a generally-rectangular removeable access panel defined by perforations. A pull tab is formed on one edge of the removeable panel to enable a recipient to easily remove the access panel from the face of the envelope to get to the contents of the second envelope pocket.

2 Claims, 3 Drawing Figures

DUAL POCKET ENVELOPE

This is a continuation of application Ser. No. 885,603 filed Mar. 3, 1978, now abandoned.

BACKGROUND OF THE INVENTION

The present invention relates to envelopes and more particularly to a dual pocket, easy opening envelope.

Dual pocket envelopes are used by mailers who wish to physically separate two or more related items which should reach a recipient simultaneously. For example, a corporation may wish to include a proxy statement with an annual report to assure that a stockholder sees the annual report before filling out the proxy statement. Similarly, a mail order company may wish to include a statement with a new catalog while physically separating the two items so that a recipient will not unknowingly set the statement aside with the catalog.

Different types of dual pocket envelopes have been developed for uses such as those described above and for other similar uses. U.S. Pat. No. 3,420,432 discloses a dual pocket envelope fabricated from a single blank of sheet material which has been folded in such a way as to define two envelope pockets. Access to the smaller of the two envelope pockets is gained by means of a tab at one edge of a viewing window. The tab is defined by perforations which diverge from the window toward the edge of the second envelope pocket. To tear this tab away, a recipient must insert a pencil or another similar implement between the window and the underside of the tab and to lift to begin tearing the envelope material along the perforated lines.

The envelope disclosed in this patent provides a partial solution to one of the primary problems with known dual pocket envelopes; namely, how to provide the user access to the contents of the second envelope pocket without severely damaging the portion of the envelope which protects the contents of the first envelope pocket. Other dual pocket envelopes have required that the recipient either open the first envelope pocket or tear the envelope surface at the second pocket to get to the contents of the second envelope pocket. The contents of both the first and second pockets are relatively easily damaged during attempts to open such envelopes. Further, even if the user is able to extract material from the second envelope pocket without damaging the contents of either pocket, the envelope itself may be so mangled that the user may be inclined to destroy it and simply store or file the contents of both pockets together rather than replacing the material in the envelope for purposes of temporary storage or further handling.

SUMMARY OF THE INVENTION

The present invention is a dual pocket envelope which overcomes the above-discussed problems by permitting a recipient to easily and neatly obtain access to the contents of a second envelope pocket without damaging the envelope in any way which would detract from its continued use for storage of the materials contained therein.

A dual pocket easy opening envelope constructed in accordance with the present invention includes first and second hinged panels of approximately the same size. The first panel has first and second side flaps which are folded inwardly over the second panel to define a first envelope pocket. A separate panel is secured at its edges to an inner surface of the first panel to define a second envelope pocket encompassed by the first and second panels. A removeable access panel, defined by a generally rectangular pattern of perforations formed in the first panel, overlays at least thirty percent of the second envelope pocket. The perforations are interrupted by at least one pull tab at one edge enabling a recipient to easily remove the entire access panel to get to the contents of the second envelope pocket.

DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

DETAILED DESCRIPTION

Figure 1:
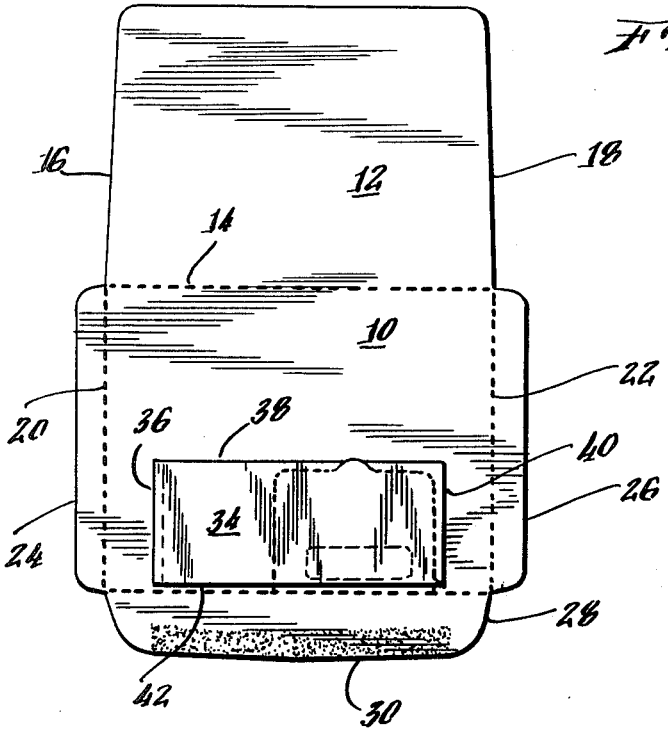
FIG. 1 is an elevational view of a preferred form of the envelope before folding.

FIG. 1 is an elevational view showing the inside surfaces of the envelope i.e., the surfaces which are normally concealed from view once the envelope has been folded into its final form. The envelope includes a generally rectangular first or front panel 10 and a second or rear panel 12 connected to the front panel 10 along a line 14. The rear panel 12 is approximately the same size as the front panel 10 but preferably includes tapered side edges 16 and 18 to reduce the chances that the edges of the rear panel 12 will extend beyond fold lines 20 and 22 on the front panel 10 when the rear panel 12 is folded against the front panel 10 about the fold line 14. The fold line 20 is the boundary between the front panel 10 and a first side flap 24. The fold line 22 is the boundary between the front panel 10 and a second side flap 26. A cover flap 28 having an adhesive coated area 30 is connected to the front panel 10 at a fold line 32.

A first or large envelope pocket is formed by folding the rear panel 12 about fold line 14 into position against the inner surface of the front panel 10. The side flaps 24 and 26, which are preferably coated with a layer of adhesive material, are folded inwardly against the outer surface of the rear panel 12 to seal the front and rear panels together at their edges.

A second smaller envelope pocket is formed by a second panel 34 which preferably includes an adhesive coating along edges 36, 38 and 40 for securing the separate panel 34 to the inner surface of the front panel 10. The fourth side 42 of panel 34 is left open so that the material to be mailed can be readily inserted into the second envelope pocket. The inserted material in both the first envelope pocket and the second envelope pocket is held in place by folding the cover flap 28 about the fold line 32 to bring the adhesive-coated area 30 into contact with the outer surface of the rear panel 12.

Access to the contents of the first envelope pocket is obtained by breaking the seal formed by the cover flap 28. Independent access to the contents of the second envelope pocket is obtained by means of a removeable access panel 44 which overlays at least thirty percent of the second envelope pocket.

Figure 2:
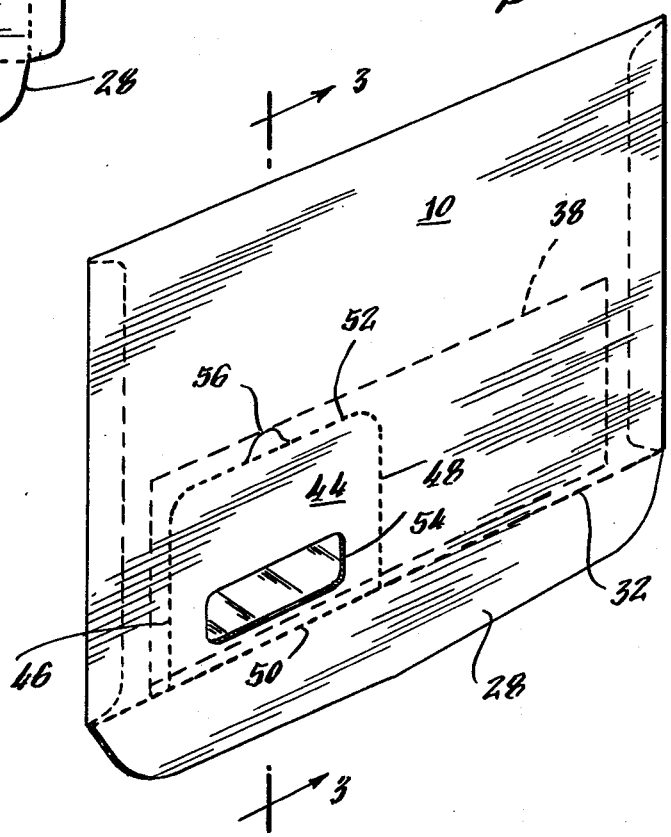
FIG. 2 is a perspective view of the envelope in its folded state.

The access panel 44 is shown more clearly in FIG. 2 as a generally rectangular pattern of perforations including a first edge 46 adjacent one edge of the second envelope pocket, a second edge 48 bisecting the front panel portion of the second envelope pocket, a third edge 50 which coincides substantially with the fold line 32 for the cover flap 28 and a fourth edge 52 parallel to the upper edge of the second envelope pocket. The four sides of the removeable access panel 44 encompass a viewing window 54 which preferably includes a transparent protective material such as glassine. The upper edge 52 of panel 44 includes a pull tab 56 formed by a semicircular scoring cut in the front panel 10. Both ends of the scoring cut merge into edge 52.

To reach the contents of the second envelope pocket, a user grips the semicircular pull tab 56 and lifts the tab away from the front panel 10 to completely separate the access panel 44 from the front panel. In a preferred embodiment of the invention, the access panel 44 is approximately the same height as the second envelope pocket and extends to one end of the pocket to permit a user to easily remove the contents of the second pocket. Since the access panel 44 is completely removable, the envelope structure is not seriously damaged by removal of the access panel, allowing the envelope to be used for continued storage of the mailing material if the user so desires.

Figure 3:
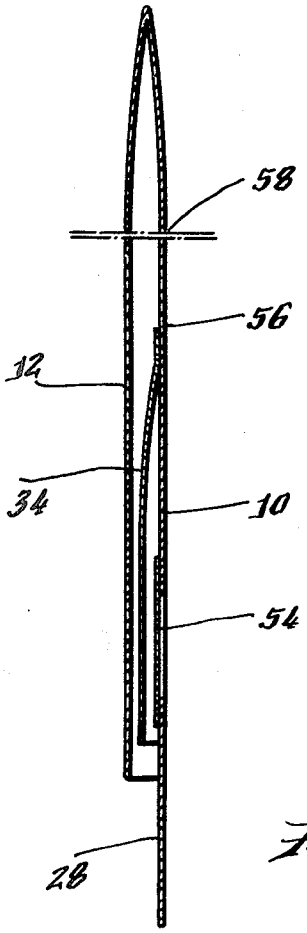
FIG. 3 is a cross sectional view of an envelope taken along lines 3—3 of FIG. 2.

FIG. 3 is a cross sectional, elevational view of the envelope, the height of which has been shortened for purposes of illustration by omitting a section at break lines 58. The omitted section is of course identical to the sections immediately above and below the break lines. The uppermost point of the semicircular pull tab 56 is preferably even with the upper edge 38 of the separate panel 34. Preferably, the scoring cut which defines the semicircular pull tab 56 extends only through front panel 10. Realistically, the normal tolerances of equipment employed in manufacturing the envelope may result in a scoring cut which extends both through front panel 10 and separate panel 34.

While there has been described what is considered to be a preferred embodiment of the invention, variations and modifications therein will occur to those skilled in the art once they have become acquainted with the basic concepts of the invention. Therefore, it is intended that the appended claims shall be construed to include all such variations and modifications as fall within the true spirit and scope of the invention.

What is claimed is:

1. A dual pocket easy-opening envelope made from a suitable sheet material comprising a first panel, a second panel hingedly connected to said first panel and substantially coextensive therewith, first and second side flaps hingedly connected to said first panel, said side flaps being folded over and secured to the surface of said second panel to define a first envelope pocket, a separate panel secured at its edges to an inner surface of said first panel to define a second envelope pocket encompassed by the first and second panels, said first panel further including a cover flap connected to the edge of said first panel opposite the edge to which said second panel is connected, said cover flap being adapted to be secured against said second panel to seal both the first envelope pocket and the second envelope pocket, said separate panel being secured to said first panel on three sides while remaining open at the edge which is adjacent the cover flap on said first panel, a removable access panel defined by a generally rectangular pattern of perforations in said first panel, said access panel overlying at least thirty percent of the second envelope pocket, said access panel extending the full height of the second envelope pocket to facilitate removal of the contents thereof, and wherein one edge of said access panel coincides with the edge of said first panel at which said cover flap is connected, said access panel further including a pull-tab at one edge thereof, which pull-tab is formed by a semicircular excursion from one line of perforations into said first panel, the excursion being a continuous cut.

2. A dual pocket easy opening envelope as recited in claim 1 wherein said first panel includes a window for viewing the contents of the second envelope pocket.

* * * * *